US007494300B2

(12) United States Patent
Blank

(10) Patent No.: US 7,494,300 B2
(45) Date of Patent: Feb. 24, 2009

(54) ICE ANCHOR

(76) Inventor: Michael F. Blank, 1516 Lakeshore Dr., Menasha, WI (US) 54952

( * ) Notice: Subject to any disclaimer, the term of this patent is extended or adjusted under 35 U.S.C. 154(b) by 0 days.

(21) Appl. No.: 11/557,995

(22) Filed: Nov. 9, 2006

(65) Prior Publication Data

US 2008/0112764 A1 May 15, 2008

(51) Int. Cl.
*E21D 21/00* (2006.01)

(52) U.S. Cl. ..... 405/259.1

(58) Field of Classification Search ..... 405/259.1; 52/156, 166, 159; 135/118
See application file for complete search history.

(56) References Cited

U.S. PATENT DOCUMENTS

| | | | | | |
|---|---|---|---|---|---|
| 1,253,746 | A | | 1/1918 | Teeling | |
| 3,134,186 | A | | 5/1964 | Krueger | |
| 3,694,950 | A | | 10/1972 | Maier | |
| 4,568,036 | A | * | 2/1986 | Kearney | 52/157 |
| 4,666,345 | A | * | 5/1987 | Seegmiller | 405/259.5 |
| 4,747,226 | A | | 5/1988 | Todd | |
| 4,794,718 | A | | 1/1989 | Tillman | |
| 4,974,997 | A | * | 12/1990 | Sero et al. | 405/259.1 |
| 4,980,986 | A | | 1/1991 | Harper | |
| 5,048,220 | A | | 9/1991 | Harris | |
| 5,192,169 | A | * | 3/1993 | Landsberg | 405/259.1 |
| 5,911,569 | A | | 6/1999 | Isakson | |
| 5,971,668 | A | * | 10/1999 | Miller | 405/259.1 |
| 6,298,611 | B1 | * | 10/2001 | Oliver et al. | 52/157 |
| 6,349,514 | B1 | * | 2/2002 | Adams | 52/155 |
| 6,675,523 | B1 | | 1/2004 | Huiras | |
| 6,725,872 | B2 | * | 4/2004 | Kindell et al. | 135/118 |
| 6,772,551 | B1 | | 8/2004 | Bielinski | |
| 6,827,994 | B2 | * | 12/2004 | Ellman et al. | 135/118 |
| 6,909,845 | B1 | | 6/2005 | Schillinger | |
| 7,082,954 | B1 | * | 8/2006 | Flanery et al. | 135/118 |
| 7,302,904 | B2 | * | 12/2007 | Burns | 52/155 |
| 2005/0138856 | A1 | | 6/2005 | Hansen | |
| 2006/0096151 | A1 | | 5/2006 | Zazzara | |

FOREIGN PATENT DOCUMENTS

| | | |
|---|---|---|
| CA | 1250745 | 3/1989 |
| GB | 2140842 | * 12/1984 |

* cited by examiner

*Primary Examiner*—Frederick L Lagman
(74) *Attorney, Agent, or Firm*—Godfrey & Kahn, S.C.; Alan R. Stewart

(57) ABSTRACT

An ice anchor and method of use thereof for securing or rescuing a vehicle which has become stuck or trapped while on a frozen surface of a body of water. The ice anchor may include blades which form a shaft and fit into an opening in the ice, and plates that limit insertion of the anchor into the hole and define an attachment area for a safety device such as a rope, chain, or cable, which may include a tensioning device. When lateral force is placed on the shaft by tensioning the safety device, the outer surfaces of the blades engage the inner wall of the hole and oppose the lateral forces, allowing the vehicle to be removed from the gap or opening in the ice.

16 Claims, 5 Drawing Sheets

ICE ANCHOR

BACKGROUND OF THE INVENTION

The present invention relates generally to an ice anchor. In particular, the present invention relates to an ice anchor and method for securing and retrieving various objects, including but not limited to, a variety of vehicles. More particularly, the present invention relates to an ice anchor and method of use thereof for securing a vehicle to a fixed point while on a frozen surface.

Many people venture out on the surface of frozen bodies of water for recreation or other purposes. Often, these people go out on the ice using some motorized vehicle, which might be a car, truck, ATV, snowmobile, or other similar vehicle. It is not uncommon for these vehicles out on the ice to become stuck in openings in the ice or otherwise immobilized. Unless another vehicle is present to assist in moving the stuck vehicle, some fixed point may be needed to move the vehicle using, for example, a rope and winch, or some other pulling device. On an ice surface, it may be difficult to find a suitable fixed feature or object to anchor a pulling device to move the stuck vehicle. If the vehicle becomes stuck near a shore or island, an object such as a tree, a stump, a rock or other fixed feature may provide an anchor point. However, vehicles may not become trapped or stuck near such a conveniently placed fixed feature.

It is desirable to provide a portable device that is capable to being positioned on or in the ice surface of a body of water to serve as an anchor for moving a stuck vehicle.

Since many people venturing out onto an ice surface of a body of water may be fishing, these people may be likely to carry an ice auger or other device for forming a generally standard sized hole in the ice to fish through. Since these ice fishers may be liable to become stuck on the ice, it may be desirable to provide an ice anchor sized to fit within a standard sized ice fishing hole.

Emergency response crews or personnel may be called to the scene of a stuck vehicle or a ship or boat trapped in the ice. To effect a rescue, these emergency response crews may desire one or more fixed anchor points to which rescue devices may be attached. Such emergency response crews may not have any convenient fixed objects or closely positioned ice fishing holes to work with. It is desirable that portable ice anchors be provided to assist rescuers in providing an anchor wherever an opening can be formed in a ice surface of a body of water.

SUMMARY OF THE INVENTION

The present disclosure relates to an ice anchor and method for use thereof for securing or rescuing vehicles stuck or immobilized on a frozen surface of a body of water. The device may include a shaft with a plurality of blades and may be configured to be placed into an opening in the ice and engage with the walls of the hole. The device may also include one or more plates positioned about the shaft. A top portion of the device may remain above the ice and to provide for attachment of a safety device such as a rope, chain or cable. Using a rope, cable, or chain, the vehicle may be connected to the device and a tensioning device may be used to pull the vehicle to a new location.

The present disclosure also relates to a method of providing an anchor in the ice that may be used to attach a safety device such as a rope, chain or cable and that may also be used to anchor a tensioning device for pulling the vehicle to a new location.

While one possible application of the present disclosure is in connection with an ice anchor, many other applications are possible and references to use in connection with an ice anchor should not be deemed to limit the uses of the devices or methods of the present disclosure. The terms "ice anchor," "blade," or "plate" as used herein should not be interpreted as being limited to specific forms, shapes, or compositions. Rather, the parts may have a wide variety of shapes and forms and may be composed of a wide variety of materials.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION

Figure 1:
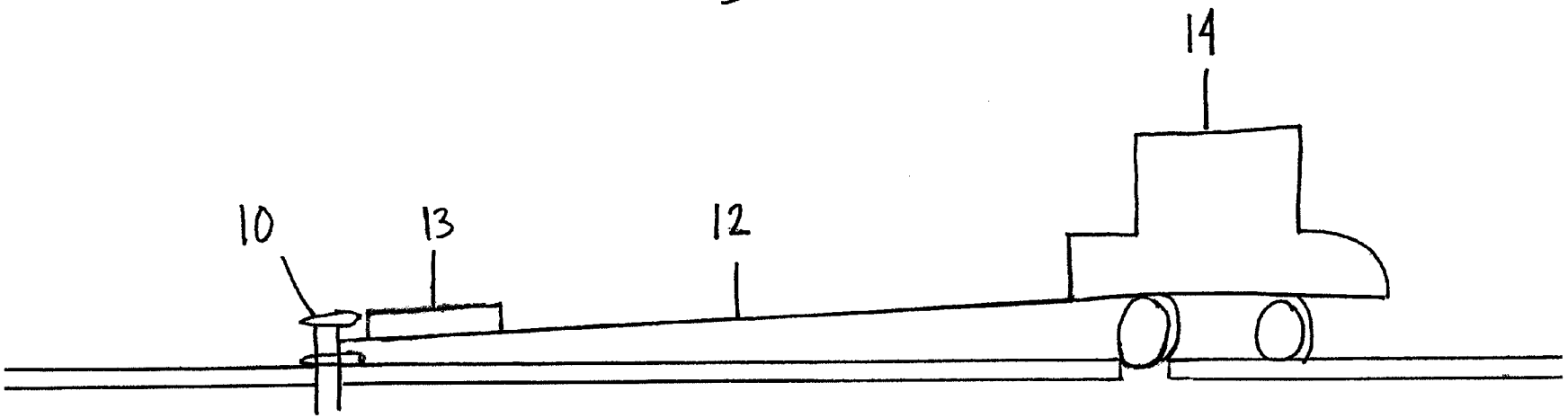
FIG. 1 is an illustrative view of the method of use for the ice anchor in conjunction with a frozen surface, a rope, a tensioning device and a vehicle according to an exemplary embodiment.

While the device of the present disclosure may be susceptible to alternative constructions, there are shown in the drawings, and herein are described in detail, a certain illustrative embodiment with the understanding that the present disclosure is to be considered an exemplification of the principles of the invention, and is not intended to limit the disclosure to the construction as illustrated and described herein. Additionally, features illustrated and described with respect to the illustrated embodiment could be used in connection with alternative constructions of the embodiment. Wherever possible, the same reference numbers will be used throughout the drawings to refer to the same or like parts.

Referring to the FIGS., an exemplary embodiment and method of use of an ice anchor intended for securing an object to a fixed point on a frozen surface is shown. According to this embodiment, the device may provide an anchor, fixed point, stabilization, etc. by the placement of the ice anchor in a hole, gap, or opening in a frozen surface to allow for the securement of a vehicle when coupled with a safety device such as a rope, chain, or cable. A tensioning device may be used in conjunction with the safety device to reposition the vehicle.

Referring now to FIG. 1, an ice anchor 10 may be placed into a hole in the ice. One end of a safety device 12 may be attached to the ice anchor 10 and the other to a vehicle 14. A tensioning device 13 may be positioned between vehicle 14 and anchor 10. Tensioning device 13 may be a block and tackle arrangement, a come-along, a winch (either power or manually operated) or some other similar device which may tension safety device 12 between ice anchor 10 and vehicle 14. Tensioning of safety device 12 may cause lateral forces to be exerted on the ice anchor 10.

Figure 2:
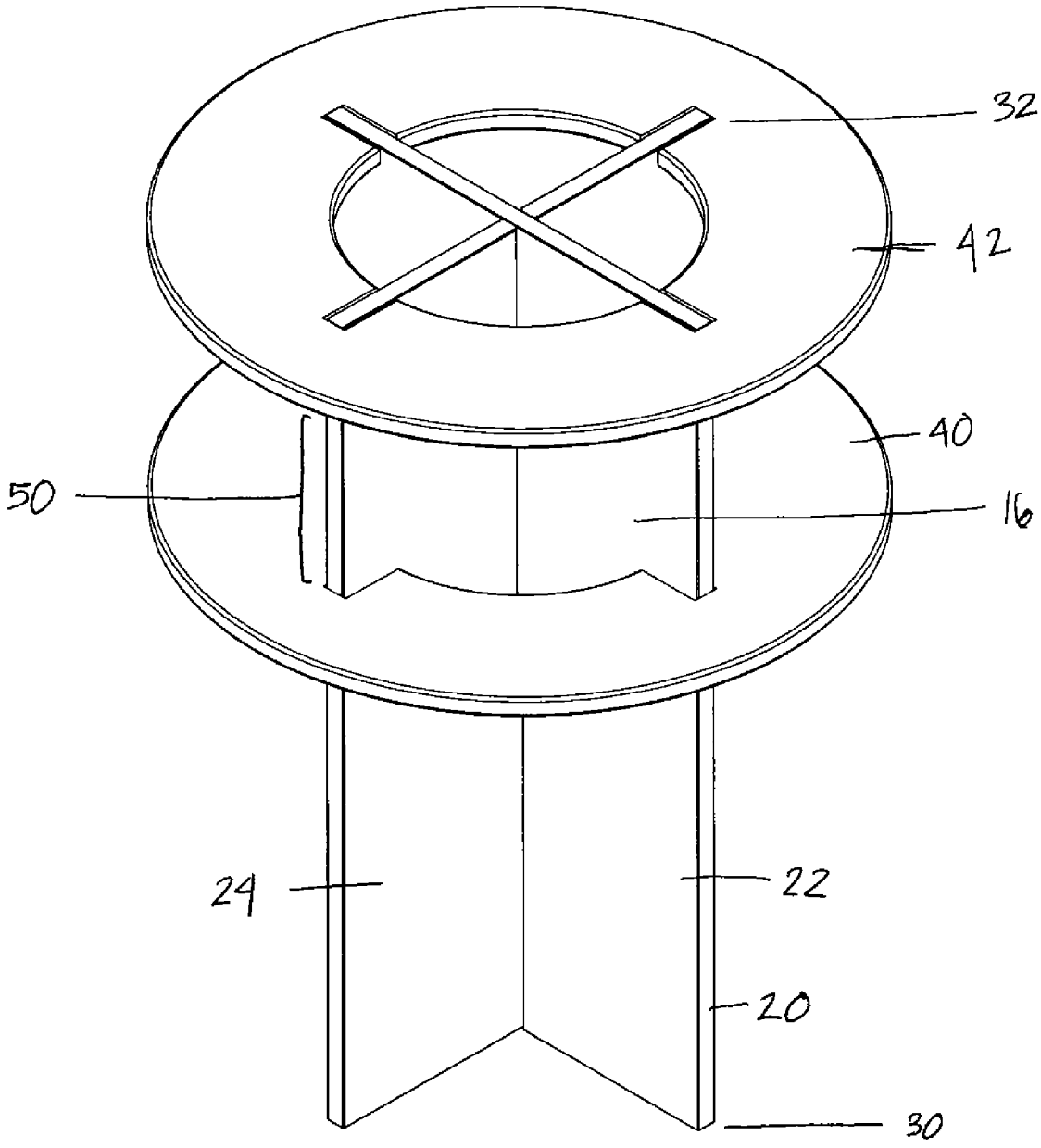
FIG. 2 is a front perspective view of an ice anchor according to an exemplary embodiment.
Figure 3:
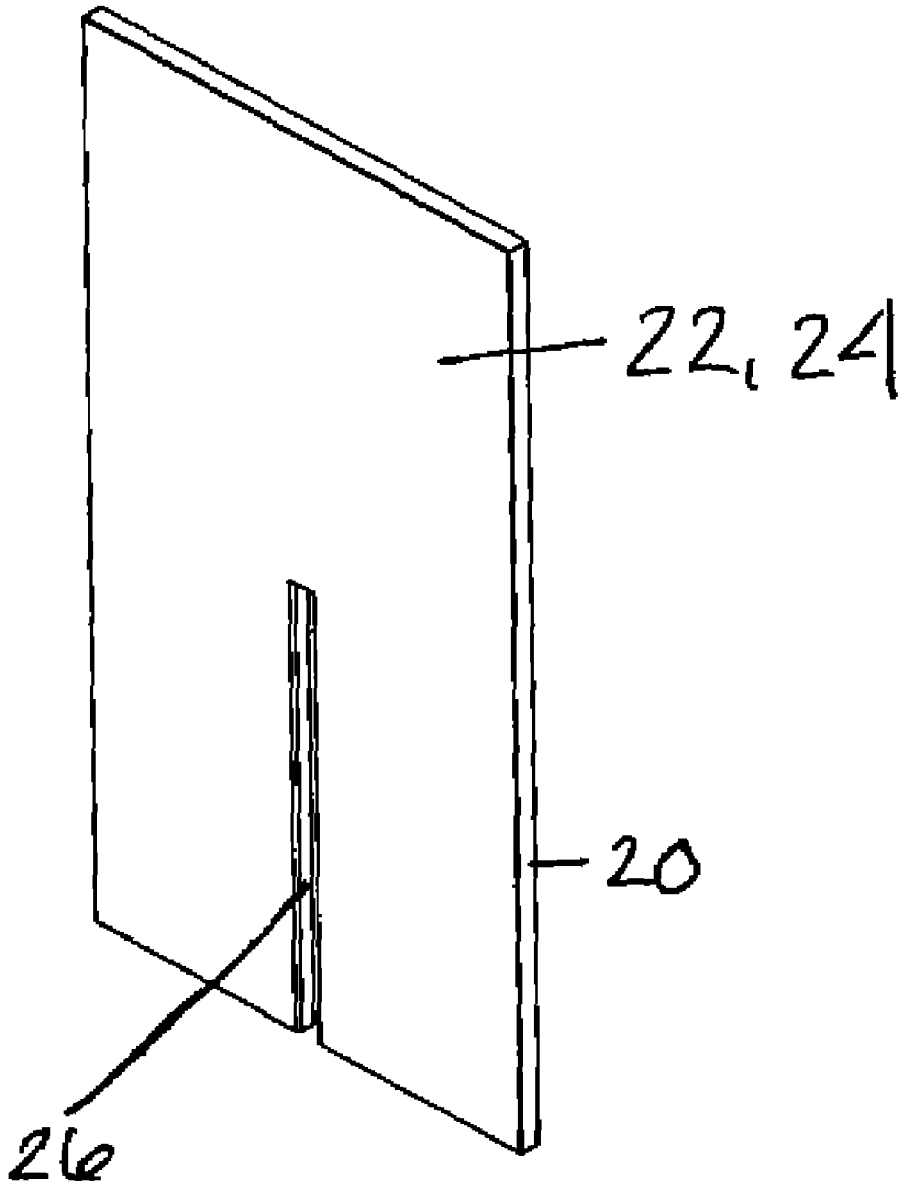
FIG. 3 is a perspective view of a blade of the shaft of the ice anchor of FIG. 2.

Referring now to FIGS. 2 and 3, such lateral force exerted on ice anchor 10 may cause one or more of four outer edges 20 formed by the interlocking blades 22, 24 of the shaft 16 to engage with an inner wall or edge of the hole to resist the lateral force and provide a stabilization point for the vehicle 14. With ice anchor 10 secured within the opening in the ice, ice anchor 10 may provide a fixed point relative to vehicle 14 permitting tension in safety device 12 to urge and move vehicle 14 out of a possible stuck or immobilized position.

Shaft 16 may be comprised of two identical blades 22, 24 which may interlock perpendicularly using the cutouts 26 in the center of the blades 22, 24. The blades 22, 24 may be made of steel and welded together to form shaft 16. The assembled shaft 16 has an inferior end 30 and a superior end 32. Outer edges 20 may be defined by blades 22, 24 of shaft 16 and may be configured to engage with the edges of the hole when placed through the opening of the hole. The hole into which ice anchor 10 may be inserted should preferably have at least two opposing inner surfaces or side walls to engage at least two of the outer edges 20 and hold ice anchor 10 against lateral forces. These side walls or inner surfaces are preferably closely sized to match a spacing of outer edges 20.

Ice anchor 10 may be sized to match a standard or commonly sized ise drill or auger, such as an auger used to bore holes in the ice for ice fishing. The size of these holes may typically be regulated by state or federal laws or rules and may tend to be standardized for a particular jurisdiction or area. Ice anchor 10 may be sized to fit closely within a standard sized hole so that the anchor may be used in conjunction with common ice boring equipment. Ice anchor 10 may also be made in a larger or smaller size to coordinate closely with an opening in the ice made by a specially sized ice drill or auger. Such an anchor/auger combination may be tailored to the needs of emergency response personnel or crews. It may be desirable to have larger sized anchors or smaller sized anchors (and ice holes sized to match the different anchors) which may be used for different situations that an emergency response crew might encounter.

For example, smaller anchors may be more versatile in fitting into cracks or other naturally occurring fissures or forms in the ice so that a emergency response crew may utilize existing conditions to effect a rescue. Alternatively, for example, a ship or boat intended to venture into known icing conditions may want to have a larger anchor and a correspondingly sized auger to provide an anchor capable of resisting a larger later load.

Figure 4:
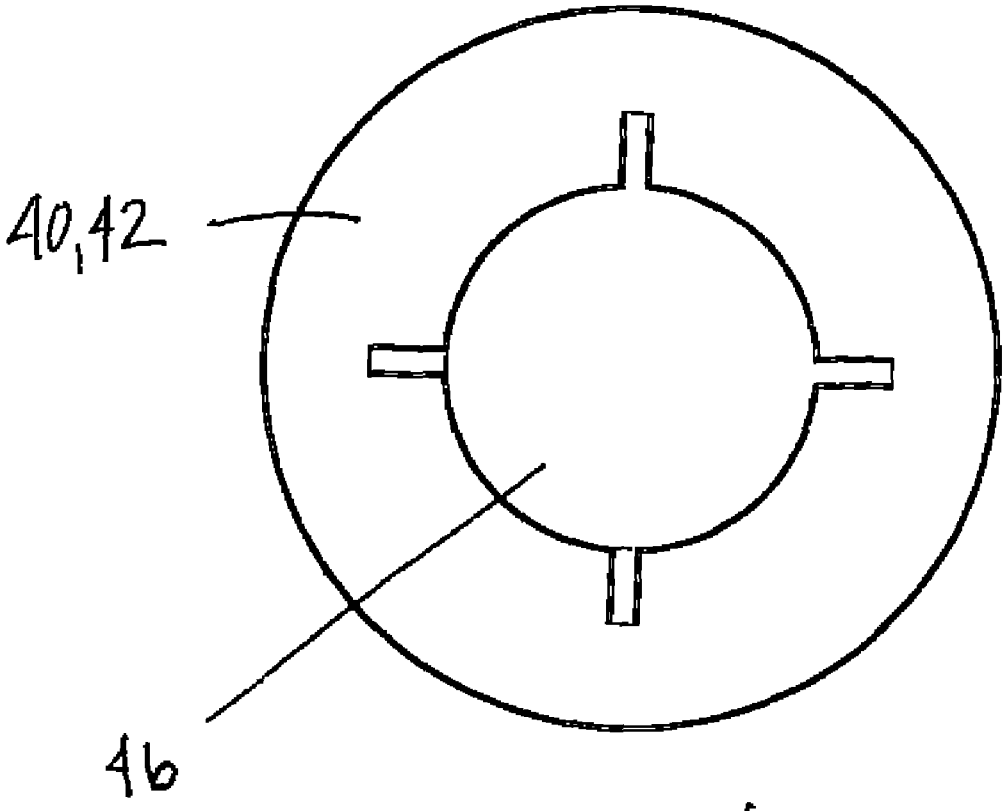
FIG. 4 is a top view of a plate of the ice anchor of FIG. 2.
Figure 5:
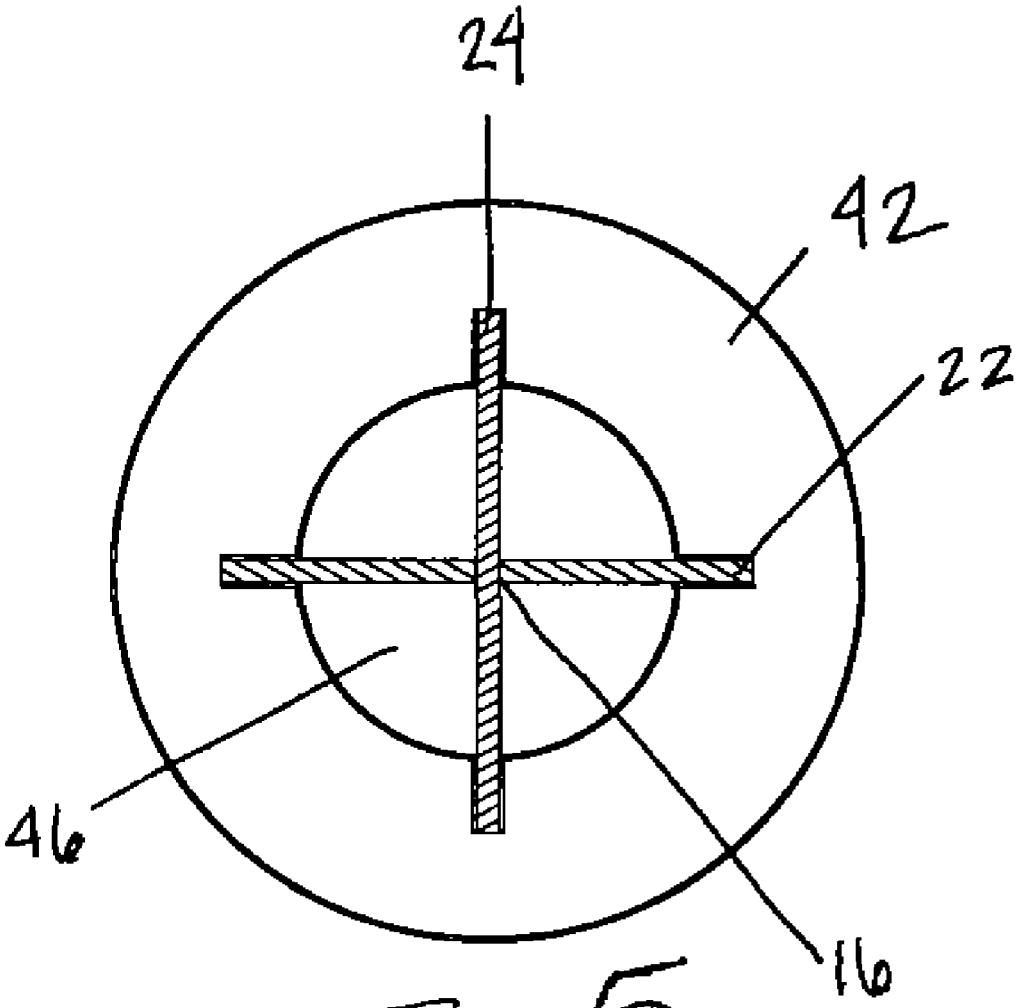
FIG. 5 is a top view of the ice anchor of FIG. 2.

Referring to FIGS. 4 and 5, the ice anchor may also comprise a lower plate 40 and an upper plate 42 which may be identically configured. Lower plate 40 and upper plate 42 both may include an opening 46 into which perpendicular blades 22, 24 of shaft 16 can be positioned.

As seen in FIG. 2, lower plate 40 may be positioned between the inferior end 30 and superior end 32 at an intermediate position on the shaft 16. A second, upper plate 42 may be positioned adjacent to superior end 32 of shaft 16. Lower plate 40 and upper plate 42 may be made of steel and welded onto the shaft 16. An attachment area 50 may be defined along shaft 16 between lower plate 40 and upper plate 42, providing an attachment point for a safety device 12. Safety device 12 can be tied, fastened, hooked, fixed, etc. onto shaft 16 in the attachment area, and upper plate 42 may provide a plane or upper limit to prevent safety device 12 from sliding up attachment area 50 and detaching itself from ice anchor 10 when load is applied. Inferior end 30 of ice anchor 10 may be placed into an opening in the ice surface, and lower plate 40 may be sized to be larger than the opening to prevent attachment area 50 and superior end 32 from insertion into the opening.

In an alternative construction, blades 22, 24 and plates 40, 42 of ice anchor 10 could be made from another material, such as plastic or another polymeric material capable of withstanding cold temperatures and providing the required strength to resist the lateral forces from safety device 12. Blades 22, 24 could be connected using glue or another adhesive rather than welding, and lower plate 40 and upper plate 42 attached in a similar manner. Alternatively, blades 22, 24 and plates 40, 42 could be held together by fasteners such as screws, bolt, or rivets, or may be held together by friction or press-fitting, or some combination of the above described fastening methods or approaches. Alternatively, ice anchor 10 could be molded as one unit, as opposed to the fabrication of separate pieces described in the preferred embodiment. Additionally, the overall size of the ice anchor 10 could be increased or decreased to correspond to the size of the legal ice fishing hole diameter allowed in a particular state. The size could also be increased more significantly to provide a larger ice anchor 10 for larger forces, such as use by emergency crews to retrieve large vehicles.

In yet another alternative construction, the number of blades 22, 24 and outer surfaces 20 could be varied, for example by welding three blades together to form six outer surfaces 20 with which to engage the edge of the opening of the ice, or by molding one member with three blades. Plates 40, 42 could be a non-circular shape or vary in diameter relative to the size of shaft 16. Further, the number of plates 40, 42 could be increased to provide additional attachment areas 50, decreased by removing lower plate 40 and providing some other insertion limiting feature, or decreased by removing upper plate 42 and instead configuring the shaft to include a groove or channel to secure safety device 12 in place.

Method of Anchoring a Vehicle on an Ice Surface

Also disclosed herein is a method of anchoring a vehicle 14 which has become trapped in a gap or hole on the frozen surface of a body of water. The method may include providing ice anchor 10 disclosed herein and inserting an end of shaft 16 into a hole or opening in the ice surface. Inferior end 30 of the shaft 16 may be sized to fit into the opening in the ice, and lower plate 40 may have a diameter larger than the hole to prevent attachment area 50 and superior end 32 of shaft 16 from insertion into the hole. The hole can be an existing hole in the ice, such as one previously drilled for ice fishing, or can be drilled at the time needed to anchor the vehicle 14.

The method may also include attaching, tying or otherwise fixing one end of safety device 12 such as a rope, chain, or cable to attachment area 50 of shaft 16 and the other end to vehicle 14. Tensioning device 13 may be included in safety device 12 or may be a separate device that may be placed between vehicle 14 and ice anchor 10 to provide tension on safety device 12. Tensioning device 13 may be used to pull on safety device 12, and, using the stabilization of the ice anchor 10, vehicle 14 can be removed from the gap or hole it has become trapped in. When lateral force is placed on ice anchor 10 by safety device 12, the force is resisted by the engagement of outer surfaces 20 of the shaft of the anchor with the inner walls or edges of the hole. After the vehicle has been freed from the ice, safety device 12 (and tensioning device 13) can be detached from shaft 16 and vehicle 14, ice anchor 10 may be removed from the hole, and both may be placed in the vehicle for easy storage or future use.

While the system and method hereinbefore described is effectively adapted to address the desires described in the Background, it is understood that the present disclosure is not intended to be limited to the specific examples or embodiments set forth above. Rather, it is to be taken as including all reasonable equivalents to the subject matter of the claims appended to this disclosure.

What is claimed is:

1. An ice anchor comprising:

a shaft with an inferior end and a superior end and a plate positioned about the shaft and secured to the shaft between the inferior and superior ends;

the shaft is defined by at least two transverse blades extending through the plate to the superior end, the blades each having an outer edge which is configured to engage the inner wall of the opening in the ice;

the shaft between the inferior end and the plate sized to fit within an opening in a sheet of ice on a body of water and engage an inner wall of the opening;

the plate sized to prevent insertion of the superior end within the opening, the plate extending generally equidistantly about shaft;

the shaft between the superior end and the plate configured to provide an attachment area for a safety device extending about the shaft and oppose lateral forces exerted by the safety device.

2. The ice anchor of claim 1, further comprising a second plate secured to the shaft adjacent to the superior end, the plate and second plate defining a space between them about the shaft for the attachment of the safety device.

3. The ice anchor of claim 2, wherein the upper plate is a generally flat plane with a central opening within which the superior end of the shaft is secured.

4. The ice anchor of claim 1, wherein the plate includes an opening through which the shaft passes.

5. The ice anchor of claim 1, wherein the shaft is comprised of two blades interlocking with each other and generally perpendicular to each other, each blade extending between the inferior and superior ends, and each blade including two opposing outer edges.

6. The ice anchor of clam 5, wherein each blade includes a centrally located slot into which the other blade is received.

7. The ice anchor of claim 6, wherein each blade is identical to the other blade.

8. The ice anchor of claim 5, wherein the diameter of the outer edge of the blades is slightly less than the legal diameter of a hole drilled by an ice fishing auger.

9. The ice anchor of claim 1, wherein the plate is a generally flat plane with a central opening through which the shaft extends.

10. A method of anchoring a vehicle on an ice surface, comprising:

providing an opening in the ice surface;

providing an ice anchor having a shaft and a plate positioned about the shaft, the shaft having an inferior end defining a diameter sized to fit within the opening in a surface of ice on one side of the plate and a superior end defining an attachment area about the shaft on the opposite side of the plate, the shaft is defined by at least two transverse blades extending through the plate to the superior end, the blades each having an outer edge which is configured to engage the inner wall of the opening in the ice, the plate extending generally equidistantly about shaft;

placing the inferior end of the shaft of the ice anchor into the hole;

securing a safety device to the ice anchor about the shaft in the attachment area and to the vehicle;

tensioning the safety device between the vehicle and the anchor.

11. The method of claim 10, wherein the vehicle is trapped within a second opening in the ice, the method further comprising applying tension to the safety device to aid removing the vehicle from the second opening.

12. The method of claim 10, further comprising securing a tensioning device between the ice anchor and the vehicle, and using the tensioning device to the tension the safety device.

13. The method of claim 10, further comprising boring the opening in the ice surface to receive the ice anchor.

14. The method of claim 10, wherein the shaft of the ice anchor comprises at least one blade defining at least two opposing outer surfaces and the opposing outer surfaces are configured to engage the opening in the ice surface when the safety device is tensioned.

15. The method of claim 14, wherein the shaft of the ice anchor comprises two interlocking blades defining four outer surfaces.

16. The method of claim 10, wherein the ice anchor includes a second plate secured adjacent the superior end of the shaft and forming an upper limit to the attachment area.

* * * * *